US008350499B2

(12) United States Patent
Nelson

(10) Patent No.: US 8,350,499 B2
(45) Date of Patent: Jan. 8, 2013

(54) HIGH EFFICIENCY POWER CONDITIONING CIRCUIT FOR LIGHTING DEVICE

(75) Inventor: Theodore G. Nelson, Portland, OR (US)

(73) Assignee: C. Crane Company, Inc., Fortuna, CA (US)

( * ) Notice: Subject to any disclaimer, the term of this patent is extended or adjusted under 35 U.S.C. 154(b) by 152 days.

(21) Appl. No.: 12/652,016

(22) Filed: Jan. 4, 2010

(65) Prior Publication Data

US 2010/0156325 A1 Jun. 24, 2010

Related U.S. Application Data

(63) Continuation-in-part of application No. 12/365,862, filed on Feb. 4, 2009.

(60) Provisional application No. 61/026,714, filed on Feb. 6, 2008.

(51) Int. Cl.
*H05B 37/02* (2006.01)

(52) U.S. Cl. ..... 315/307; 315/291; 315/297; 315/209 R; 315/294

(58) Field of Classification Search ..... 315/209 R, 315/291, 294, 307, 312, 343, 297
See application file for complete search history.

(56) References Cited

U.S. PATENT DOCUMENTS

| | | | |
|---|---|---|---|
| D344,605 | S | 2/1994 | Aspenwall |
| 5,430,356 | A | 7/1995 | Ference |
| 5,475,241 | A | 12/1995 | Harrah et al. |
| D434,175 | S | 11/2000 | Fahmian |
| 6,465,961 | B1 | 10/2002 | Cao |
| 6,495,964 | B1 | 12/2002 | Muthu et al. |
| 6,601,976 | B1 | 8/2003 | Rhee |
| 6,659,632 | B2 | 12/2003 | Chen |
| D508,575 | S | 8/2005 | Buschmann et al. |
| 6,982,518 | B2 | 1/2006 | Chou et al. |
| 7,014,336 | B1 | 3/2006 | Ducharme |
| 7,038,399 | B2 | 5/2006 | Lys et al. |
| D528,227 | S | 9/2006 | Chou et al. |
| 7,102,902 | B1 | 9/2006 | Brown et al. |
| D531,741 | S | 11/2006 | Takahashi |

(Continued)

FOREIGN PATENT DOCUMENTS

WO WO/2009/100160 8/2009

OTHER PUBLICATIONS

Stolowitz Ford Cowger, Listing of Related Cases, May 26, 2011.

(Continued)

*Primary Examiner* — Douglas W Owens
*Assistant Examiner* — Jonathan Cooper
(74) *Attorney, Agent, or Firm* — Stolowitz Ford Cowger LLP

(57) ABSTRACT

A power conditioning circuit in a light bulb efficiently converts an Alternating Current (AC) input voltage into Direct Current (DC) power for operating LEDs in the light bulb. The power conditioning circuit discharges capacitors when a voltage level of the input voltage drops below a given voltage necessary to operate the LEDs. The capacitors are then recharged when the input voltage is high enough to power the LED. The capacitors are configured to operate as voltage dividers while being charged thus reducing a peak voltage level of the output voltage used for powering the LEDs. The reduced output voltage reduces the overall amount of energy used by the light bulb and reduces the amount of heat radiated by the light bulb.

21 Claims, 7 Drawing Sheets

U.S. PATENT DOCUMENTS

| | | | |
|---|---|---|---|
| D534,665 | S | 1/2007 | Egawa et al. |
| D538,953 | S | 3/2007 | Mama |
| D541,440 | S | 4/2007 | Feit |
| D545,477 | S | 6/2007 | DeBruyne et al. |
| 7,255,457 | B2 | 8/2007 | Ducharme |
| D553,267 | S | 10/2007 | Yuen |
| 7,352,138 | B2 | 4/2008 | Lys et al. |
| D572,400 | S | 7/2008 | Benensohn |
| 7,396,146 | B2 | 7/2008 | Wang |
| D582,577 | S | 12/2008 | Yuen |
| D584,444 | S | 1/2009 | Lipson |
| D584,844 | S | 1/2009 | Ghini |
| 7,494,241 | B2 | 2/2009 | McCarthy et al. |
| D590,523 | S | 4/2009 | Takahashi |
| 2003/0127994 | A1 | 7/2003 | Patchomik et al. |
| 2004/0114367 | A1 | 6/2004 | Li |
| 2005/0253533 | A1 | 11/2005 | Lys et al. |
| 2007/0103086 | A1 | 5/2007 | Neudorf |
| 2007/0127235 | A1 | 6/2007 | Cooper et al. |
| 2007/0267984 | A1 * | 11/2007 | Peng ..... 315/312 |
| 2009/0175041 | A1 | 7/2009 | Yuen |

OTHER PUBLICATIONS

Master Bond Polymer System EP30AN-1 Product Description [online], Mar. 23, 2005, [Retrieved on Mar. 5, 2009] Retrieved from the internet: <URL: http://www.masterbond.com/tds/ep30an-1.html>.

International Search Report for PCT/US2009/033118; Mailed Apr. 3, 2009.

Written Opinion of the International Searching Authority for PCT/US2009/033118; Mailed Apr. 3, 2009.

Stolowitz Ford Cowger LLP, Listing of Related Cases, Apr. 24, 2012.

* cited by examiner

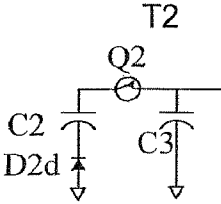
FIG. 7A
FIG. 7B
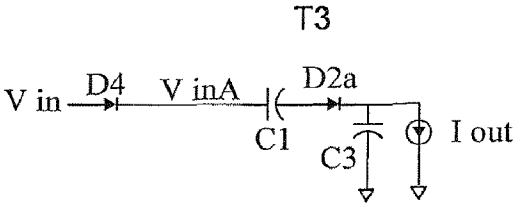
FIG. 7C
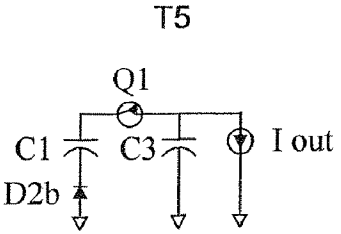
FIG. 7D
FIG. 7E
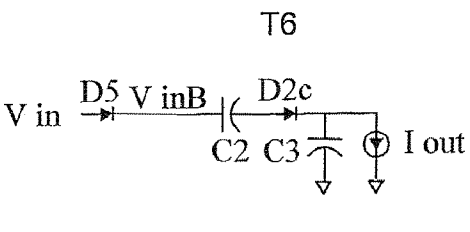
FIG. 7F
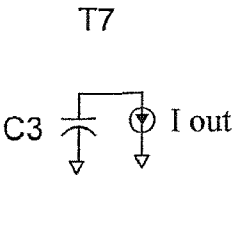
FIG. 7G

HIGH EFFICIENCY POWER CONDITIONING CIRCUIT FOR LIGHTING DEVICE

This application is a continuation-in-part of U.S. patent application Ser. No. 12/365,862, filed Feb. 4, 2009, and entitled: LIGHT EMITTING DIODE LIGHTING DEVICE which claims priority to U.S. Provisional Application No. 61/026,714, filed Feb. 6, 2008, where are both herein incorporated by reference in their entirety.

BACKGROUND

Light Emitting Diodes (LEDs) can be more energy efficient than conventional incandescent lights and compact florescent lights. However, LED lights generate heat that can negatively affect performance, energy efficiency, and life expectancy. The LED lights have LEDs that are driven by a digital circuit and powered by a Direct Current (DC) power supply. A capacitor circuit is typically used in conjunction with a rectified output from an Alternating Current (AC) power supply to produce a DC voltage for operating the LEDs. However, a substantial amount of power is wasted in the capacitor circuit when converting the AC input voltage into a DC output voltage for powering the LEDs.

SUMMARY

A lighting device uses a more energy efficient power conditioning circuit to reduce the amount of power used by LED lights.

BRIEF DESCRIPTION OF THE DRAWINGS

FIGS. 7A-7G show different operating stages of the power conditioning circuit of FIG. 6.

DETAILED DESCRIPTION

Figure 1:
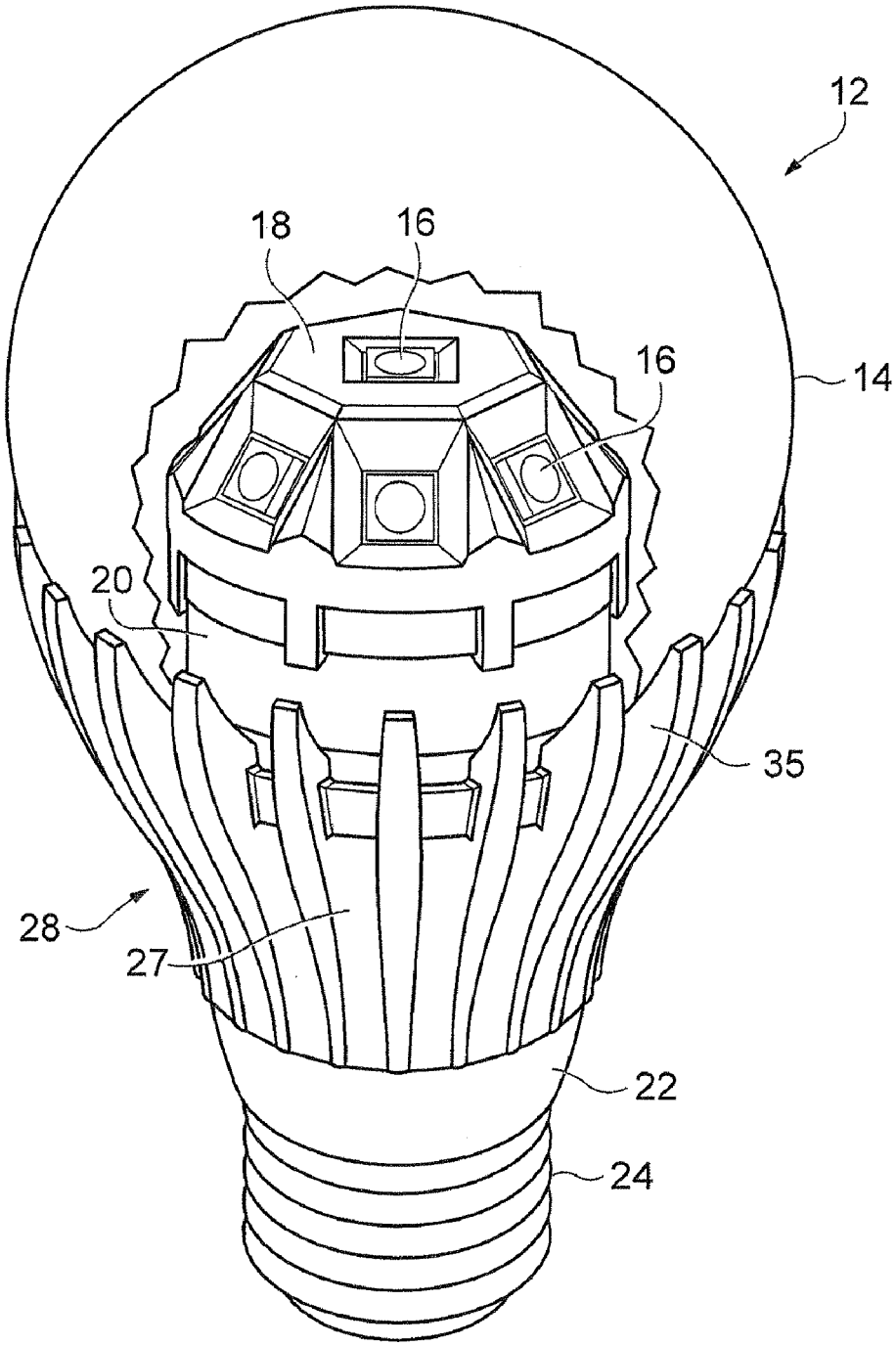
FIG. 1 is a perspective view of an energy efficient Light Emitting Diode (LED) lighting device.

FIG. 1 is a perspective view of a LED light bulb 12 that can replace standard incandescent and florescent lights. An array of LEDs 16 reside on an aluminum mounting head 18 and are aligned radially outward at inclining angles from a center axis of the LED light 12. An additional LED 16 is positioned horizontally upward on a top surface of the aluminum mounting head 18.

A glass or plastic bulb 14 is positioned over the LEDs 16 and attaches to the top of an aluminum heat transfer body 20. The heat transfer body 20 extends from the mounting head 18 down to an Edison style screw base connector 24. A plastic insulator 22 is attached between a bottom end of the heat transfer body 20 and a top end of the base connector 24. The base connector 24 screws into a conventional 120 volt Alternating Current (AC) light socket. Metal heat sink fingers 25 extend radially outward and upward from an outside surface of heat transfer body 20 and extend partially up the sides of the bulb 14. Lesser thermally conductive aluminum wedges 27 are inserted between adjacent heat sink fingers 25.

The LED bulb 12 can output light at the same levels as incandescent light bulbs while using less power. The LEDs 16 are more rugged than filaments or florescent tubes and can operate longer than incandescent and florescent lights. For example, one embodiment of the LED light 12 has a life expectancy of around 50,000 hours.

The unique arrangement, shape, and materials of the mounting head 18, heat transfer body 20, and heat sink fingers 25 are referred to generally as heat sink structure 28. The heat sink structure 28 more effectively transfers heat away from the LEDs 20 thus allowing the light bulb 12 to operate more efficiently by keeping the junction temperature of the LEDs 16 lower. The heat transfer structure 28 can alternatively be made out of other heat conductive materials other than aluminum, such as ceramic or other metals. A more detailed description for one embodiment of the heat transfer structure 28 is described in co-pending application Ser. No. 12/365,862, which has incorporated by reference.

Inefficient Power Consumption

As mentioned above, circuitry in LED light bulbs may not efficiently convert an AC voltage into a DC voltage for operating the LEDs in the light bulb. For example, current in the LED load is used while the voltage is high (i.e., 160 volts). This reduces the Power Factor (PF), and power efficiency, of the LED light.

Figure 2:
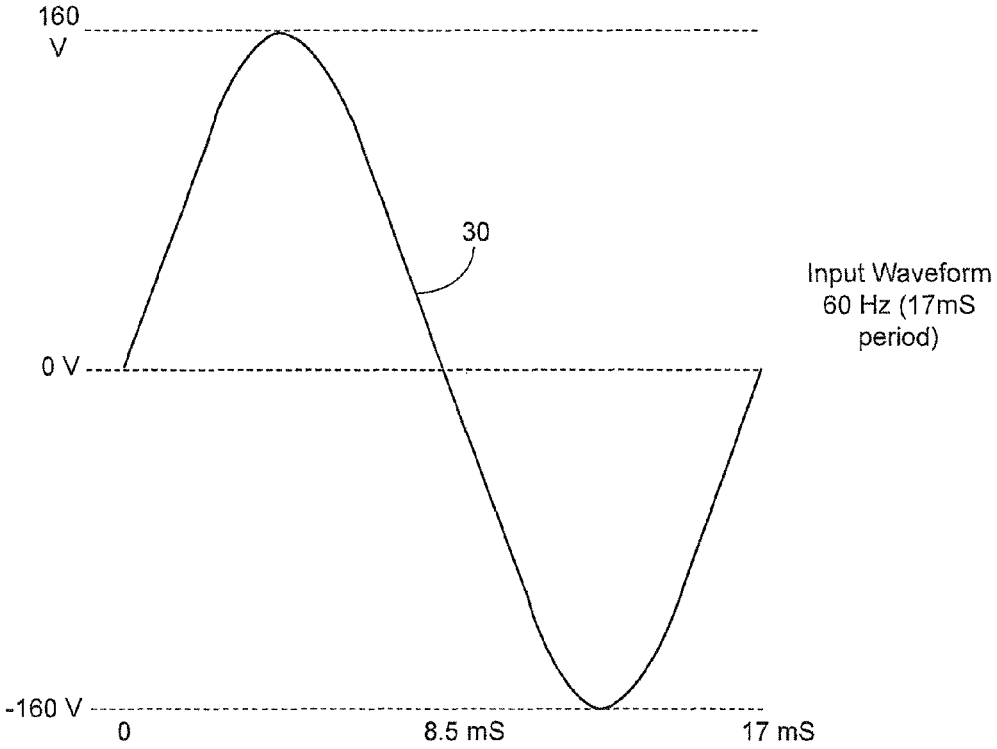
FIG. 2 is diagram of a 160 volt Alternating Current (AC) waveform.
Figure 3:
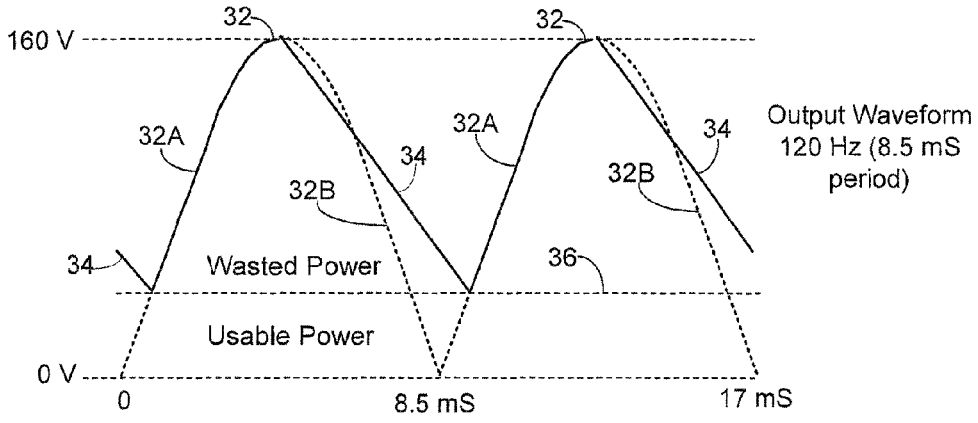
FIG. 3 is diagram of a 160 volt rectified AC waveform that uses capacitors to maintain constant Direct Current (DC) voltage level.

To explain further, FIG. 2 shows a conventional AC 60 Hertz (Hz) 160 volt input voltage waveform 30 that is typically used for powering the LED light 12. FIG. 3 shows a rectified output voltage 32 created by passing the AC voltage 30 in FIG. 2 through a full-wave rectifier. A line 36 represents a power cut-off. Power provided by rectified AC voltage 32 below line 36 provides a constant current supply to the LEDs 16 in the LED light bulb 12.

Due to the alternating nature of the rectified voltage 32 and the operating characteristics of the LEDs 16, any power above voltage level 36 cannot be used for powering the LEDs 16 and is therefore wasted. For example, whenever the rectified voltage 32 drops below level 36 the LEDs 16 shut off and causes the LED light 12 to flicker. Capacitors are used in conjunction with the rectified voltage 32 to prevent this periodic drop in the rectified output voltage 32 below LED operating level 36.

During the rising slopes 32A, the rectified voltage 32 both powers the LEDs 16 and charges one or more capacitors. During the falling slopes 32B, the capacitors are discharged creating an output voltage 34. The capacitors discharge slower than the falling slope of rectified voltage 32B. This maintains the output voltage above the LED voltage operating level 36 until the next rising slope 32A of the second half cycle of the rectified voltage 32 rises above voltage level 36. The rectified voltage 32, in combination with the capacitors, maintains a substantially constant current source that allows the LEDS 16 to be continuously operated without any flickering.

The operation described above is inefficient since most of the output power provided above voltage level 36 is wasted and not needed for operating the LEDs 16. The power provided by rectified input voltage 32 above voltage level 36 is excess power that is at least partially expended in the form of heat that radiates from the LED light bulb 12. Heat can also be radiated from the inductor 150 and the FET 148 shown in FIG. 4. Larger value capacitors could be used for raising the usable power level 36. However, large electrolytic capacitors typically have shorter life spans than ceramic capacitors. Thus, large capacitors would not operate well in relatively small low-cost LED light bulbs.

Efficient Power Line to LED Driver Circuit

Figure 4:
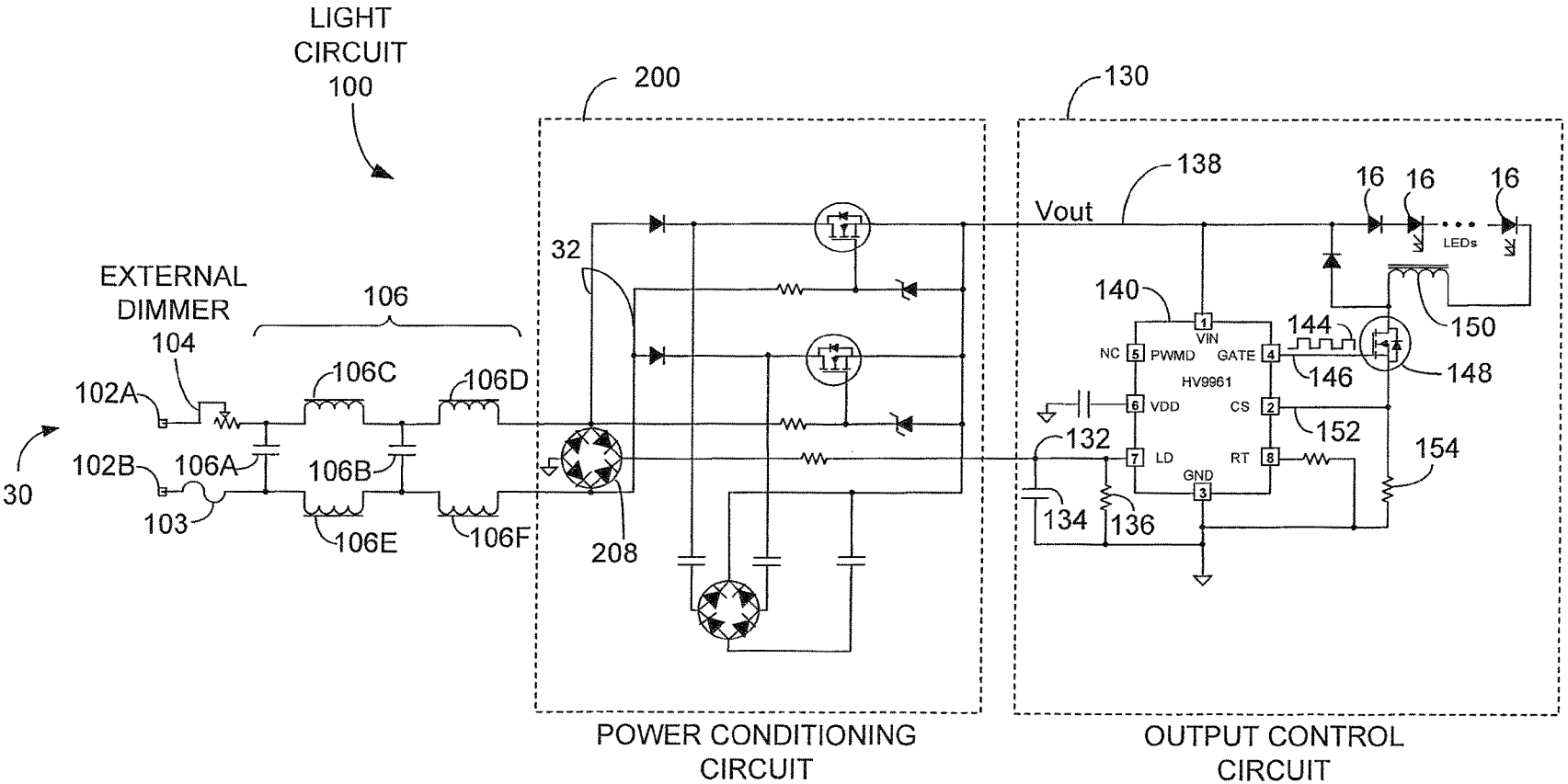
FIG. 4 is a circuit diagram of an energy efficient control circuit used in the LED light shown in FIG. 1.

FIG. 4 shows a light circuit 100 that improves the efficiency of the LED light bulb shown in FIG. 1. In one embodiment, the light circuit 100 is located on a printed circuit board that is retained within the lower section of light bulb 12 shown in FIG. 1. Co-pending application Ser. No. 12/365,862, which is incorporated by reference, shows in more detail a printed circuit board containing light circuit 100 located within light bulb 12.

Terminals 102A and 102B are connected to a standard Edison style connector 24 as previously shown in FIG. 1. The terminals 102 receive AC power 30 as shown in FIG. 2. A slow-blow fuse 103 blows before tripping a home circuit breaker. A dimmer switch 104 varies the AC voltage level fed into the light circuit 100, but is usually external to the light bulb.

A filter circuit 106 includes a capacitor 106A, and two inductors 106C and 106D. The filter formed by 106A, 106C, and 106D is repeated again with capacitor 106B, and inductors 106E and 2106F to form a four pole filter. Filter circuit 106 works in both directions, preventing noise on the AC voltage source 30 from interfering with the operation of circuit 100 and also preventing noise created by the circuit 100 from going back out on the input voltage source 30.

A full wave bridge rectifier 208 converts the input voltage 30 (+/−160V) into the rectified 160 volt DC voltage 32 shown in FIG. 3. The voltage 32 is now referenced to the lamp's internal ground. The voltage 32 goes into a power conditioning circuit 200 that increases energy efficiency by reducing the amount of input voltage used for powering the LEDs 16. The power conditioning circuit 200 is described in more detail below in FIGS. 5-8.

An output control circuit 130 includes an Integrated Circuit (IC) 140 that generates pulses 144. The IC 140 is known and therefore is not described in further detail. Of course other IC or logic circuitry could also be used. The duty cycle of the pulses 144 output from a gate 146 of IC 140 are controlled according to the voltage level on a Light Dimming (LD) input 132. The pulses 144 activate a Field Effect Transistor (FET) 148 allowing current to flow through an inductor 150 and activate LEDs 16. A current sense pin 152 on IC 140 is used to sense the current flowing through the transistor 148 by means of external sense resistor 154.

When the voltage on the CS pin 152 exceeds the lower of either an internal voltage set in the IC 140 (typically 250 milli-volts) or the voltage at the LD input 132, the output of the gate pin 146 goes low. The current through the inductor 150 starts ramping up when the transistor 148 turns on. This current flows through the external sense resistor 154 and produces a ramp voltage at the CS pin 152. Comparators in the IC 140 constantly compare the voltage on CS pin 152 to both the voltage at the LD input 132 and the internal voltage reference. An output of the internal comparators resets an internal Set-Reset (SR) flip-flop when the voltage on the CS pin 152 exceeds the voltage on LD pin 132, and drives the gate pin 146 low. The gate pin 146 goes low until the S-R flip-flop is reset by an internal oscillator.

Current output from the power conditioning circuit 200 flows through the LEDs 16 and transformer 150. The IC 140 pulses the gate of FET 148 maintains a current flow through the LEDs 16 that generates a substantially constant light source in the light bulb 12 in FIG. 1.

Increasing Energy Efficiency

Figure 5:
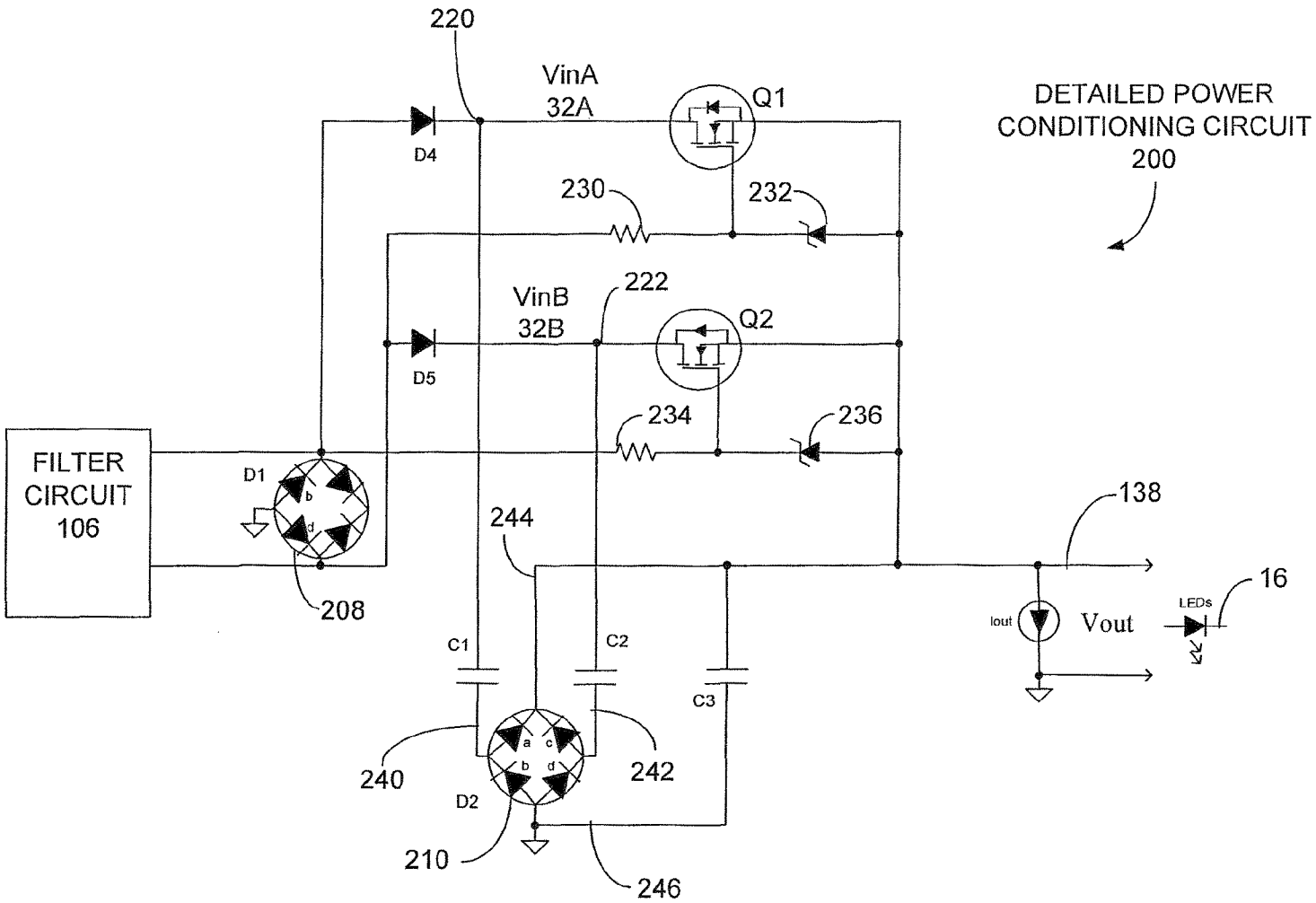
FIG. 5 is a circuit diagram of a power conditioning circuit used in the circuit shown in FIG. 4.

FIG. 5 shows the power conditioning circuit 200 of FIG. 4 in more detail. The input of the power conditioning circuit 200 receives the filtered AC power 30 from the filter circuit 106 previously described in FIG. 4. The output of conditioning circuit 200 provides the voltage output 138 to the output control circuit 130 that powers the IC 140 and LEDs 16 of FIG. 4. The power conditioning circuit 200 could be used to power other DC lighting circuitry other than the lighting circuit 100 shown in FIG. 4.

A bridge circuit 208 is alternatively referred to as D1 and generates the rectified input voltage 32 shown in FIG. 3. A first end of the bridge circuit 208 is coupled through a diode D4 and a FET Q1 to the output 138. A second end of the bridge circuit 208 is coupled through a diode D5 and FET Q1 to output 138. A Zenor diode 232 and resistor 230 provide a voltage reference at the gate of transistor Q1 and a Zenor diode 236 and resistor 234 provide a voltage reference at the gate of transistor Q1.

A second bridge circuit 210 is alternatively referred to as D2. A first terminal 240 of bridge 210 is connected through capacitor C1 to a first node 220 between diode D4 and transistor Q1. A second terminal 242 of bridge 210 is connected through capacitor C2 to a node 222 between diode D5 and transistor Q2. A third terminal 244 of bridge 210 is connected to the voltage output terminal 138 and through capacitor C3 to grounded terminal 246. The node 220 receives the first half cycle 32A of the rectified voltage 32 previously shown in FIG. 3. The node 222 receives the second half cycle 32B of the rectified voltage 32 previously shown in FIG. 3.

First Input Voltage Half Cycle

The power conditioning circuit 200 sequences charge on capacitors to maintain a relatively low output voltage. The capacitor charge sequencing is timed responsive to the input voltage Vin. By splitting operation of the input bridge circuit 208 between two input signals, VinA and VinB, more precise control can be achieved over the output voltage Vout during in the 60 Hz voltage cycle.

Figure 6:
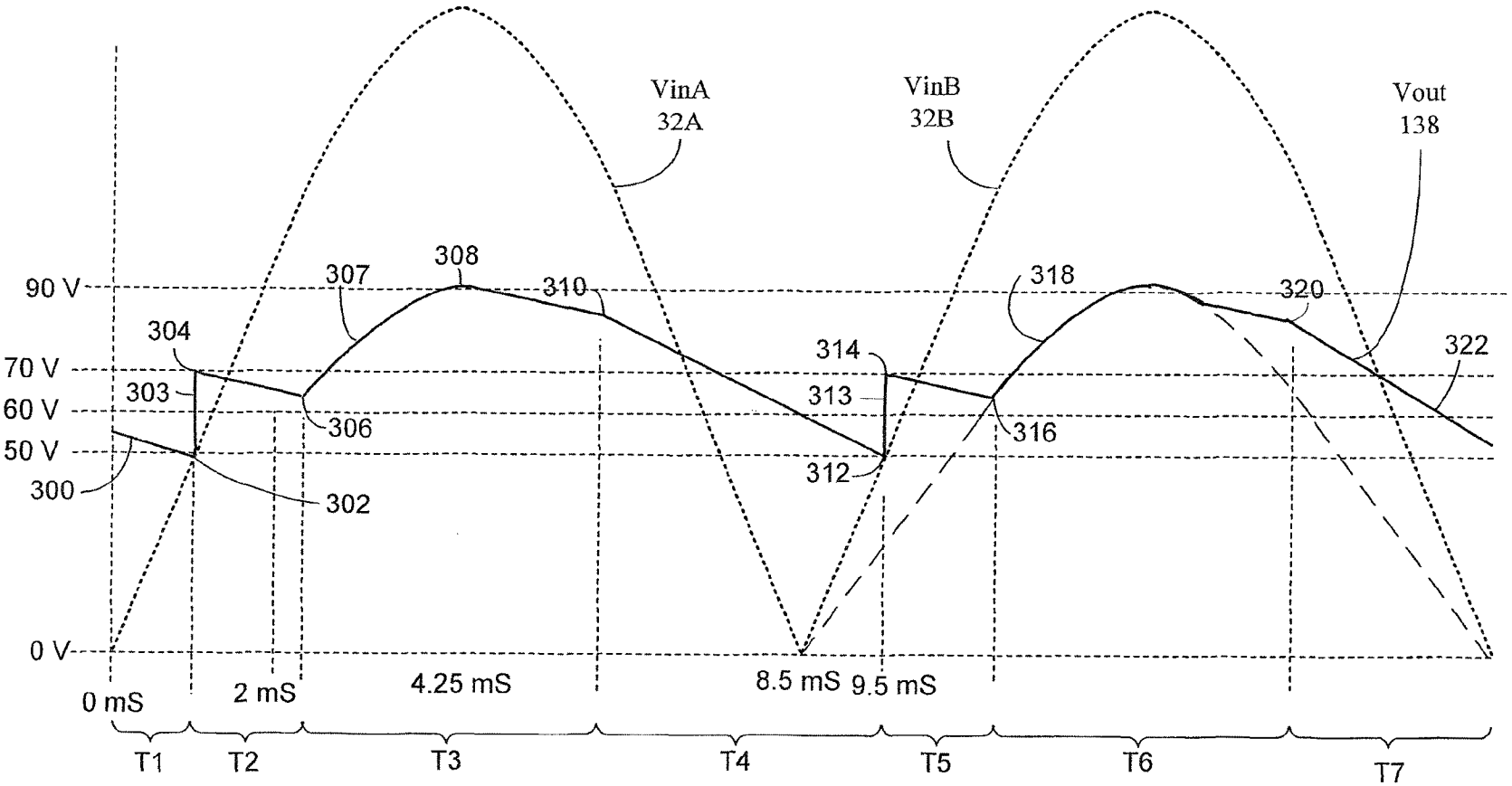
FIG. 6 is a waveform diagram showing the output voltage generated by the power conditioning circuit in FIG. 5.

The operation of the power conditioning circuit 200 in FIG. 5 will be explained in conjunctions with FIGS. 6 and 7. FIG. 6 shows the first half cycle 32A of the rectified input voltage alternatively referred to as VinA and the second half cycle 32B of the rectified input voltage is alternatively referred to as VinB. The time period T1 represents a first operating stage of the power conditioning circuit 200 where capacitor C3 has previously been charged and is currently discharging voltage 300 to the load connected to node 138 at Iout. In this example, the output load at Iout includes the LEDs 16 and the other components in output control circuit 130 in FIG. 4. The functional configuration of the circuit 200 during the first operating stage during time T1 is shown in FIG. 7A where capacitor C3 is shown discharging to the output Iout.

When the voltage VinA rises to around 50 volts at point 302 in waveform 32A in FIG. 6, the gate of FET Q2 turns on. The FET Q2 shorts capacitor C2 with capacitor C3.

Capacitor C2 was previously charged and now discharges through FET Q2 both into capacitor C3 and to Iout. This is represented by line 303 in FIG. 6 where the output voltage Vout quickly increases from 50 volts (v) at point 302 to around 70 v at point 304. After the voltage in capacitors C2 and C3 stabilize to around 70 v, both capacitors discharge into the load at output Iout during time T2. The functional equivalent of circuit 200 during this second operating stage for time period T2 is shown in FIG. 7B. Here, capacitor C2 is coupled through FET Q2 both to capacitor C3 and Iout.

The capacitors C2 and C3 continue to discharge until point 306 in FIG. 6. Diode D4 and diode D2*a* in bridge circuit 210 both become forward biased. The diode D2*d* in bridge circuit 210 then becomes reverse biased and turns off and the FET Q2 also turns off. This forms a voltage divider with capacitor C1 on top and capacitor C3 on the bottom, each being charged to about one half of VinA. Current from input voltage VinA flows through D4 charging capacitor C1 and continues through diode D2*a* into capacitor C3 and output Iout. The output voltage Vout represented by line 307 in FIG. 6 is the voltage divided output generated from the input voltage Vin.

The operation stage of the circuit 200 during time T3 is represented in FIG. 7C where the voltage Vin is coupled through diode D4 to capacitor C1. The opposite end of capacitor C1 is coupled through diode D2*a* in bridge 210 to capacitor C3 and to the load at output Iout.

At location 308 in FIG. 6, of the input voltage VinA starts to drop allowing the now fully charged capacitors C1 and C3 to start discharging and providing power to Iout. As the input voltage VinA continues to drop at point 310 in FIG. 6 the diodes D4 and D2A become reverse biased. This reverse biasing disconnects capacitor C1 from C3 and the output Iout. A stray current caused by a reverse bias current in the Zenor diodes 232 and/or 236 may slightly lower the output voltage between point 310 and 312.

The operation stage of the power conditioning circuit 200 during time period T4 operates effectively as shown in FIG. 7D which is similar to the operation stage shown in FIG. 7A during time period T1. In this operation stage the capacitor C3 continues to discharge into Iout as the input voltage VinA continues to drop to zero volts.

Second Half of Input Voltage Cycle

The second half of the input voltage cycle VinB occurs approximately at around 8.3 milliseconds (ms). The power conditioning circuit 200 is symmetrical, and operates in a manner similar to the first half cycle except that during the second half cycle FETs Q1 and Q2 are swapped, capacitors C1 and C2 are swapped, and the diodes in bridge circuit 210 are swapped.

During the fourth operating stage at the end of time T4, the capacitor C3 continues to discharge to point 312. When the input voltage VinB rises to around 50 volts at point 312 in FIG. 6, the gate of FET Q1 turns on. Capacitor C1 which was previously charged in the fourth operating stage during time T3 then starts discharging through FET Q1 both into capacitor C3 and into the load at output Iout. This is represented by line 313 in FIG. 6 where the output voltage Vout quickly increases from 50 v at point 312 to around 70 v at point 314.

The capacitors C1 and C3 balance to around 70 v in around 100 nanoseconds (ns) do to the low resistance of the FET Q1. The two capacitors C1 and C3 then continue to discharge into the load at Iout during time T5. Again the load includes LEDs 16. The functional equivalent of circuit 200 in the fifth operating stage during time period T5 is shown in FIG. 7E. Here, capacitor C1 is shorted through FET Q1 both to capacitor C3 and output Iout.

At point 316, the input voltage Vin increases enough to forward bias diode D5 and diode D2*c* in bridge circuit 210. The diode D2*b* in bridge circuit 210 becomes reverse biased and the FET Q1 also turns off. This forms another voltage divider with current from Vin passing through D5 into capacitor C2 and through diode D2*c* into capacitor C3 and output Iout. Capacitor C2 is at the top of the voltage divider and capacitor C3 is on the bottom of the voltage divider and are being charged to about 90 v. The voltage divided output voltage Vout is represented by line 318 in FIG. 6.

The operation of the conditioning circuit 200 during time T6 is shown in FIG. 7F where the input voltage Vin is coupled through diode D5 to capacitor C2. The opposite end of capacitor C2 is coupled through diode D2*c* in bridge 210 to capacitor C3 and to the load at output Iout.

At point 318 in FIG. 6 the charge in the capacitors C2 and C3 reach a peak voltage of around 90 v at point 318. The input voltage VinB starts to drop causing the charged capacitors C2 and C3 to start discharging and providing power to Iout while the diodes D5 and D2*c* start turning off. As the input voltage VinB continues to drop at point 320, the diodes D5 and D2*c* become reverse biased. This disconnects capacitor C2 from the output Iout leaving capacitor C3 to discharge into Iout.

The seventy operation stage of the circuit 200 during time period T7 then operates as shown in FIG. 7G which is similar to FIGS. 7A and 7D. In this stage the capacitor C3 continues to discharge into Iout as the input voltage VinB continues to drop to zero volts.

Figure 8A:
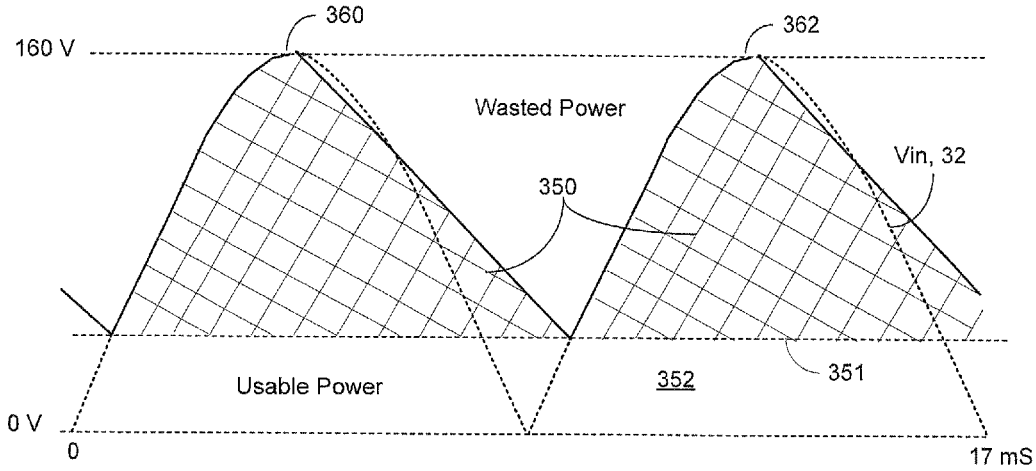
FIGS. 8A and 8B compare prior output efficiency between a prior LED light circuit and the power conditioning circuit of FIG. 5.
Figure 8B:
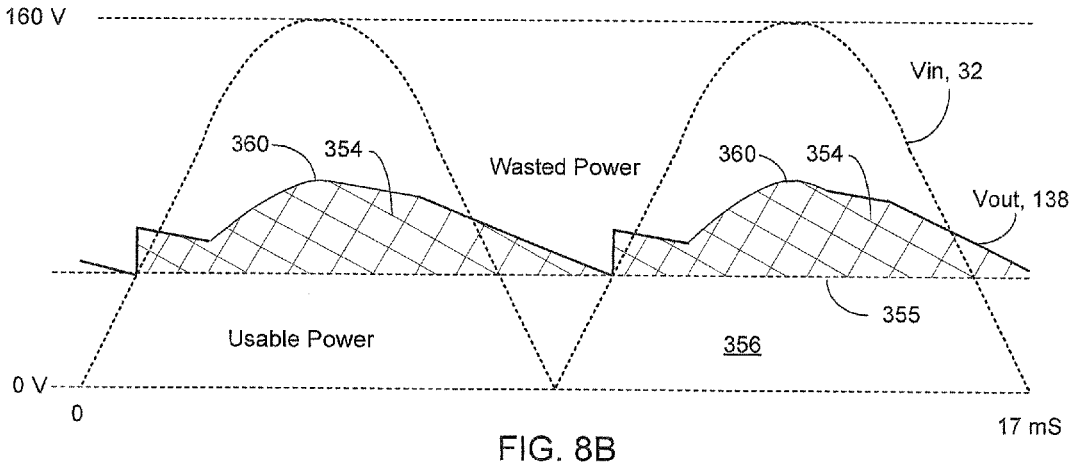

FIGS. 8A and 8B compare the output power previously shown in FIG. 3 with the output power from FIG. 6. The shaded area 350 in FIG. 8A represents the wasted power for a conventional LED light circuit and the un-shaded area 352 below line 351 represents the usable output power provided through the conventional light circuit. The shaded area 354 in FIG. 8B represents the wasted power for the improved efficiency LED power conditioning circuit 200 previously shown in FIG. 6 and the un-shaded area 356 below line 355 represents the usable power provided through the power conditioning circuit 200.

Wasted power is power that is not used for powering the LEDs 16. Useable power can be used by the LEDs 16 but may not all be used due to circuit variables. When comparing the ratio of wasted power 350 to useable power 352 in FIG. 8A with the ratio of wasted power 354 to useable power 356 in FIG. 8B it is clear that the power conditioning circuit 200 is more energy efficient.

It can be seen that the peak output voltage 360 used in FIG. 8B is substantially reduced compared with the peak output voltage 362 in FIG. 8A. The output voltage 362 in FIG. 8A is substantially the same as the rectified 160 volt peak input voltage Vin. This large 160 peak voltage unnecessarily heats up the inductor 150 (FIG. 4) and LEDs 16.

By using the capacitors C1, C2, and C3 both as a voltage divider and for charging the output voltage during the two half cycles of the rectified input voltage Vin, the conditioning circuit 200 can use a substantially lower output voltage 360 and still maintain a substantially DC power supply of round 50*v* as represented by lines 360 and 355, respectively, in FIG. 8B. In one test case, a LED light using power conditioning circuit 200 uses only 3 Watts of input power and has a Power Factor (PF) of 0.61.

The power conditioning circuit 200 uses less power and therefore reduces the amount of heat radiated by the light bulb 12. As well as saving energy, fewer and less expensive heat sink components are required in the light bulb 12. Also, the LEDs 16 and inductor 150 do not have to be rated at the high voltage levels and may operate for longer periods of time.

The system described above can use dedicated processor systems, micro controllers, programmable logic devices, or microprocessors that perform some or all of the operations. However, at least one advantage of the circuit described above is that digital logic and timing circuits are not necessarily needed. Some of the operations described above may be implemented in software, such as computer readable instructions contained on a storage media, or the same or other operations may be implemented in hardware.

For the sake of convenience, the operations are described as various interconnected functional blocks or distinct software modules. This is not necessary, however, and there may be cases where these functional blocks or modules are equivalently aggregated into a single logic device, program or operation with unclear boundaries. In any event, the functional blocks and software modules or features of the flexible interface can be implemented by themselves, or in combination with other operations in either hardware or software.

References above have been made in detail to a preferred embodiment. Examples of the preferred embodiments were illustrated in the referenced drawings. While preferred embodiments where described, it should be understood that this is not intended to limit the invention to one preferred embodiment. To the contrary, it is intended to cover alternatives, modifications, and equivalents as may be included within the spirit and scope of the invention as defined by the appended claims.

Having described and illustrated the principles of the invention in a preferred embodiment thereof, it should be apparent that the invention may be modified in arrangement and detail without departing from such principles. We/I claim all modifications and variation coming within the spirit and scope of the following claims.

The invention claimed is:

1. A circuit, comprising:

an input receiving an input voltage;

an output coupled to a control circuit, wherein the control circuit is configured to control a Light Emitting Diode (LED); and a power conditioning circuit comprising:

charge storing circuitry configured to provide a first discharge operation to the output from a first charge storing element during a first operating stage, provide a second discharge operation to the output from a second charge storing element during a second operating stage, and operate the first charge storing element and the second charge storing element as a voltage divider during a third operating stage, wherein the voltage divider reduces the input voltage into a reduced output voltage at the output for powering and maintaining operation of the LED.

2. The circuit of claim 1 wherein the first charge storing element and the second charge storing element are configured to both discharge to the output during the second discharge operation.

3. A circuit, comprising:

an input receiving a rectified input voltage;

an output coupled to a control circuit, wherein the control circuit is configured to control a Light Emitting Diode (LED); and a power conditioning circuit configured to provide a first discharge operation during a first operating stage, provide a second discharge operation during a second operating stage, and operate as a voltage divider during a third operating stage, wherein the voltage divider divides the input voltage into a reduced output voltage at the output for powering the LED, the power conditioning circuit comprising:

a first, a second and a third capacitor, wherein the third capacitor is configured to discharge to the output during the first operating stage, the second capacitor is configured to charge the third capacitor and discharge along with the third capacitor to the output during the second operating stage, and the first and second capacitor are configured to form a voltage divider for reducing the input voltage and be charged by the input voltage during the third operating stage.

4. The circuit of claim 1 wherein the power conditioning circuit is configured to operate in the first operating stage, the second operating stage and the third operating stage, and then provide a third discharge operation similar to the first discharge operation during a fourth operating stage.

5. The circuit of claim 1 wherein the power conditioning circuit is configured to provide a third discharge operation to the output from a third charge storing element during a fourth operating stage.

6. The circuit of claim 5 wherein the first charge storing element and the third charge storing element are configured to operate as a voltage divider during a fifth operating stage.

7. The circuit of claim 3, wherein the third capacitor is configured to discharge to the output during a fourth operating stage, the first capacitor is configured to charge the third capacitor and discharge along with the third capacitor to the output during a fifth operating stage, and the second and third capacitor are configured to form a second voltage divider configuration during a sixth operating stage.

8. The circuit of claim 7 wherein the conditioning circuit is configured to operate in the fourth operating stage, fifth operating stage and sixth operating stage, and then return to the first operating stage.

9. The circuit of claim 8 wherein the power conditioning circuit is configured to operate in at least part of the fourth operating stage, the fifth operating stage, the sixth operating stage, and at least part of the first operating stage during a second half cycle of the input voltage.

10. A light control circuit, comprising:

a rectifier circuit configured to convert an Alternating Current (AC) voltage into a rectified input voltage;

an output control circuit configured to control operation of a Light Emitting Diode (LED);

a power conditioning circuit comprising:

an input coupled to the rectifier circuit;

an output coupled to the output control circuit and the LED;

charge storing circuitry coupled between the input and the output; and a bridge circuit configured to cause the charge storing circuitry to:

discharge to the output during a first operating stage, store charge from the rectified input voltage during a second operating stage, and operate as a voltage divider for reducing the rectified input voltage at the output during the second operating stage.

11. A light control circuit, comprising:

a rectifier circuit configured to convert an Alternating Current (AC) voltage into an rectified input voltage;

an output control circuit configured to control operation of a Light Emitting Diode (LED);

a power conditioning circuit comprising:

an input coupled to the rectifier circuit;

an output coupled to the output control circuit and the LED;

a first switch having a first terminal coupled to a first end of the rectifier circuit, a second terminal coupled to the output, and a gate coupled to a second end of the rectifier circuit; and a second switch having a first terminal coupled to the second end of the rectifier circuit, a second terminal coupled to the output, and a gate coupled to the first end of the rectifier circuit.

12. The circuit of claim 11 wherein the power conditioning circuit further comprises:

a first capacitor coupled to the first terminal of the first switch;

a second capacitor coupled to the first terminal of the second switch; and a third capacitor coupled to the output.

13. The circuit of claim 12 including a bridge circuit coupled between the first, second and third capacitors and coupled to the output.

14. The circuit of claim 13 wherein the bridge circuit includes:

a first diode coupled at a first end to the first capacitor and coupled at a second end to the output;

a second diode coupled at a first end to the third capacitor and coupled at a second end to the first capacitor;

a third diode coupled at a first end to the second capacitor and coupled at a second end to the output; and a fourth diode coupled at a first end to the third capacitor and coupled at a second end to the second capacitor.

15. A light control circuit, comprising:

a voltage input circuit configured to receive an input voltage;

an output control circuit configured to control operation of a Light Emitting Diode (LED); and a power conditioning circuit comprising:

the voltage input an output coupled to the output control circuit and the LED;

a first capacitor;

a second capacitor; and a third capacitor, wherein:

the second capacitor charges the third capacitor and the second and third capacitor discharge power to the LED during a first half cycle of the input voltage; and the first capacitor and third capacitor operate as a voltage divider between the input and the output and are charged during the first half cycle of the input voltage.

16. The circuit of claim 15 wherein:

the first capacitor charges the third capacitor and the first and third capacitor discharge power to the LED during a second half cycle of the rectified input voltage; and the second capacitor and the third capacitor operate as a voltage divider between the input and output and are charged during the second half cycle of the rectified input voltage.

17. A method, comprising:

receiving an input voltage;

discharging a charge storage circuit to an output for operating a Light Emitting Diode (LED) during at least part of a time when a voltage level of the input voltage drops below a given voltage level for operating the LED;

charging the charge storage circuit with the output voltage when the voltage level of the input voltage is high enough for operating the LED;

configuring the charge storage circuit to operate as a voltage divider when being charged by the input voltage, wherein the voltage divider reduces a voltage level of the input voltage used for powering the LED while maintaining the voltage level high enough for operating the LED; and discharging a second charge storing element and a third charge storing element during a first half cycle of the input voltage and using the second charge storing element and the third charge storing element as the voltage divider during the first half cycle of the input voltage; and discharging a first charge storing element and the third charge storing element during a second half cycle of the input voltage and using the first charge storing element and the third charge storing element as a voltage divider during the second half cycle of the input voltage.

18. A method, comprising:

receiving an input voltage;

discharging a charge storage circuit to an output for operating a Light Emitting Diode (LED) when a voltage level of the input voltage drops below a given voltage level;

charging the charge storage circuit when the voltage level of the input voltage is high enough to power the LED;

configuring the charge storage circuit to operate as a voltage divider when being charged by the input voltage, wherein the voltage divider reduces a voltage level of the input voltage used for powering the LED;

during a first half cycle of the input voltage, discharging a second capacitor and a third capacitor to the output to power the LED when the voltage level of the input voltage drops below the given voltage level;

during the first half cycle of the input voltage, charging a first capacitor and the third capacitor when the voltage level of the input voltage is high enough to power the LED; and configuring the first capacitor and the third capacitor to operate as the voltage divider while being charged by the input voltage.

19. The method of claim 18 further comprising:

during a second half cycle of the input voltage, discharging the first capacitor and the third capacitor into the output for operating the LED when the voltage level of the input voltage drops below the given voltage level;

during the second half cycle of the input voltage, charging the second capacitor and the third capacitor when the voltage level of the input voltage is high enough to power the LED; and configuring the second capacitor and the third capacitor to operate as the voltage divider while being charged by the input voltage.

20. The method of claim 17 further comprising:

rectifying a 160 volt peak-to-peak Alternating Current (AC) voltage into a full-wave rectified 160 volt peak sinusoidal input voltage; and converting the input voltage into an approximately constant 50 volt Direct Current (DC) source at the output for powering the LED while limiting the DC source to a maximum peak voltage of approximately 90 volts.

21. The circuit of claim 10 wherein the power conditioning circuit is repeated for generating a more DC like output.

* * * * *

UNITED STATES PATENT AND TRADEMARK OFFICE

CERTIFICATE OF CORRECTION

PATENT NO. : 8,350,499 B2
APPLICATION NO. : 12/652016
DATED : January 8, 2013
INVENTOR(S) : Theodore G. Nelson It is certified that error appears in the above-identified patent and that said Letters Patent is hereby corrected as shown below:

In the Claims:

Column 9, line 20 (Claim 15): Delete “the” and insert --an input coupled to the--, therefor.

Column 9, line 20 (Claim 15): Delete “input” and insert --input circuit;--, therefor.

Signed and Sealed this
Twenty-ninth Day of April, 2014

Michelle K. Lee

Michelle K. Lee
*Deputy Director of the United States Patent and Trademark Office*